US007081723B2

(12) United States Patent
Ratzinger et al.

(10) Patent No.: US 7,081,723 B2
(45) Date of Patent: Jul. 25, 2006

(54) DRIFT TUBE ACCELERATOR FOR THE ACCELERATION OF ION PACKETS

(75) Inventors: Ulrich Ratzinger, Weiterstadt (DE); Bernhard Schlitt, Darmstadt (DE)

(73) Assignee: Gesellschaft fuer Schwerionenforschung mbH, Darmstadt (DE)

( * ) Notice: Subject to any disclaimer, the term of this patent is extended or adjusted under 35 U.S.C. 154(b) by 0 days.

(21) Appl. No.: 10/889,291

(22) Filed: Jul. 12, 2004

(65) Prior Publication Data

US 2005/0029970 A1 Feb. 10, 2005

(30) Foreign Application Priority Data

Jul. 22, 2003 (DE) ..... 103 33 454

(51) Int. Cl.

| | |
|---|---|
| ***H01J 23/00*** | (2006.01) |
| ***H01J 23/34*** | (2006.01) |
| ***H01J 25/00*** | (2006.01) |
| ***H01J 7/00*** | (2006.01) |

(52) U.S. Cl. ..... 315/500; 250/396

(58) Field of Classification Search ..... 315/500–507; 250/396

See application file for complete search history.

(56) References Cited

U.S. PATENT DOCUMENTS 4,024,426 A * 5/1977 Vaguine ..... 315/5.41
4,118,652 A * 10/1978 Vaguine ..... 315/5.41
4,150,322 A * 4/1979 Tran et al. ..... 315/5.41
4,181,894 A * 1/1980 Pottier ..... 315/500
4,596,946 A * 6/1986 Pottier ..... 315/5.41
4,746,839 A * 5/1988 Kazusa et al. ..... 315/5.41
5,578,909 A * 11/1996 Billen ..... 315/505
5,734,168 A * 3/1998 Yao ..... 250/492.3

* cited by examiner

*Primary Examiner*—Don Wong
*Assistant Examiner*—Marie Antoinette Cabucos
(74) *Attorney, Agent, or Firm*—Frommer Lawrence & Haug LLP; Ronald R. Santucci

(57) ABSTRACT

The invention relates to a drift tube accelerator (1) for the acceleration of ion packets in ion beam acceleration systems, wherein a housing (2) consists of a longitudinally divided three-part vacuum tank (3) having a central unit (4) and a lower half-shell (3) comprising a structured lower steel block (15) and an upper half-shell (6) comprising a structured upper steel block (19). (The cavity arranged between the central unit (4) and the structured steel blocks (15, 19) has at least two acceleration regions (24, 25), between which there is arranged a magnetic focussing device (17), which focuses the ion beam from one region (24) to the next region (25).)The drift tube accelerator (1) according to the invention has such a stable and massive structure that it requires no external supporting aids of any kind in order to obtain alignment, which is reliable and accurate to a few micrometers, of the acceleration components within the drift tube accelerator (1) with respect to the longitudinal axis (7) of ion beam guidance of the central unit (4). The massive structure of the drift tube accelerator (1) according to the invention can be used in general for any linear accelerator.

12 Claims, 7 Drawing Sheets

DRIFT TUBE ACCELERATOR FOR THE ACCELERATION OF ION PACKETS

This application claims priority benefits of German Patent Application No. DE 103 33 454.8 filed Jul. 22, 2003.

The invention relates to a drift tube accelerator for the acceleration of ion packets in ion beam acceleration systems. The drift tube accelerator is of the IH type and has a housing in the form of a longitudinally divided three-part vacuum tank. The vacuum tank consists of a central unit, a lower half-shell and an upper half-shell. On its longitudinal axis of ion beam guidance, the central unit has an inlet orifice and an outlet orifice for the ion packets. The central unit also has, on its inner walls located opposite one another, longitudinal ribs oriented parallel to the longitudinal axis. Arranged alternately on the longitudinal ribs are drift tube holders, which in turn hold drift tube units coaxially with respect to the longitudinal axis of ion beam guidance. The central unit having the drift tube holders is removably mounted on the lower half-shell and is removably covered by the upper half-shell.

An IH drift tube accelerator of such a kind is known from the publication U. Ratzinger "IH-Structure and its capability to accelerate high current beams", Proceedings of the High IEEE Particle Accelerator Conference (PAC91), San Francisco, 1991 (IEEE Service Center Piscataway, N.J., 1991), pages 567 to 571. Drift tube accelerators of such a kind having a central unit and an upper and lower half-shell wherein the two half-shells are of semi-cylindrical cross-section have the disadvantage that, when the tank is evacuated, because of the radially inward acting forces caused by the pressure difference between the surroundings and the inside of the tank on evacuation, the tank shrinks by up to several millimetres in its diameter in the plane of the central unit, when the internal height of the vacuum tank is greater than the internal spacing between the inner walls of the central unit, especially when there is a large length-to-diameter ratio in such vacuum tanks for IH drift tube accelerators. This results in mis-setting of the drift tube holders held by the longitudinal ribs on opposite sides of the central unit and of the drift tube units—held by those holders—with respect to one another and with respect to the longitudinal axis of ion beam guidance of the central unit.

In order to reduce that shrinkage of the tank diameter in the plane of the central frame and the resulting mis-setting of the drift tube units, the central units of those IH drift tube accelerators of conventional construction are held in dimensionally stable manner by an external supporting frame. Costly supporting frames of that kind require laborious assembly and disassembly of the cavity in the supporting frame, the supporting frame in turn itself constituting a source of error which can likewise result in mis-setting of the drift tube structure if the central frame is not held sufficiently exactly in the supporting frame.

A further problem in the case of IH drift tube accelerators of such a kind is the introduction of additional tuning members, which can be necessary, especially in the case of a drift tube accelerator cavity which is very long in comparison to its diameter, in order to bring about the requisite electrical field distribution along the longitudinal axis of ion beam guidance. When introducing additional tuning members into conventional half shells, achieving adequate high-frequency and thermal contact between the members being introduced and the half shells is possible only with difficulty, when the half shells have a semi-cylindrical cross-section. Because the high-frequency power losses take place at the inner tank surfaces, the introduced members would be heated to a very great extent because of the poor thermal contact. That can result both in electrical mistuning of the cavity during operation and also in damage to the cavity because of thermal stresses and overheating.

In some cases, IH drift tube accelerators of such a kind are equipped with up to two integrated magnetic quadrupole triplet lenses for transverse focussing of the ion beams, the supports for those quadrupole triplet lenses not being carried by the vacuum tank but being extended outwards from the vacuum tank by way of diaphragm bellows and supported in an external tank sub-frame, with the result that mis-settings can already occur on evacuation of the vacuum tank as a result of the evacuation forces occurring therein. Such supporting of the introduced quadrupole triplet lenses on an external tank sub-frame is, moreover, very costly and requires laborious installation.

A further disadvantage of conventional IH drift tube accelerators is found when there is a very great increase in the ion velocity along the drift tube accelerator, which causes, in the case of a constant drift tube accelerator operating frequency and constant gap geometry, a great decrease in the unit-length-related capacity of the drift tube structure along the accelerator. In ion acceleration, the ion velocity increases continuously along the drift tube accelerator. The centre-to-centre spacing of neighbouring drift tube units therefore increases likewise along the accelerator, which results in a substantial decrease in the unit-length-related capacity of the drift tube structure when the acceleration gaps between the drift tube units have a constant geometry.

If it is the intention then to use a single drift tube accelerator cavity for covering a very great increase in the ion velocity, there is a problem in compensating for that decrease in the unit-length-related capacity of the drift tube structure in order to be able to excite the basic mode of the cavity. It has not been possible hitherto to solve that problem in conventional IH drift tube accelerators within a single drift tube accelerator cavity; instead, in order to cover a very great increase in ion velocity, a plurality of drift tube accelerator cavities have hitherto been arranged in series, which is very laborious and very costly.

The problem of the invention is to describe a drift tube accelerator for the acceleration of ion packets by means of which the above-described problems can be solved and the disadvantages of known drift tube accelerators are overcome and their ranges of use and peripheral parameters extended. The problem of the invention is, furthermore, to reduce the investment costs of a drift tube accelerator and to increase its economic viability.

The problem is solved by the subject-matter of the independent claims. Advantageous developments of the invention are to be found in the dependent claims.

In accordance with the invention the above-described drift tube accelerator is characterised in that the lower half-shell has a structured lower steel block having a partly flat inner base, on which there can preferably be provided focussing devices, vacuum ports and/or tuning elements. The invention is furthermore characterised in that the upper half-shell has a structured upper steel block, which has a partly flat inner covering surface preferably having orifices for vacuum ports, it being possible for tuning elements to be provided on the flat regions of the covering surface.

The solution according to the invention has the advantage that it is possible to dispense with a supporting frame, because the drift tube accelerator according to the invention has intrinsic stability by virtue of the massive structured upper and lower steel blocks, which make an external supporting frame unnecessary and reliably prevent mis-setting of the drift tube units with respect to one another and with respect to the longitudinal axis of ion beam guidance of the central unit. In addition, the drift tube accelerator according to the invention has the advantage that the structured lower steel block has a partly flat inner base, on which it is advantageously possible to fix additional ion-beam-influencing components within the cavity of the vacuum tank so that mis-settings, which previously occurred between the components supported by the external sub-frame, such as triplet lenses, and the components held by the inner walls of the cavity, can no longer occur because all additional components arranged in the cavity of the vacuum tank, such as focussing devices and tuning elements, can be arranged and supported on flat portions of the inner base.

In one embodiment of the invention, the vacuum tank has at least 2 inner regions, in which the drift tubes, having alternately arranged drift tube holders, are arranged, a special drift tube, comprising a focussing device for transverse ion beam focussing and standing on the partly flat inner base of the lower structured steel block, being so arranged between each of the regions that it surrounds the longitudinal axis of the central unit. This embodiment of the invention has the advantage that subsequent adjustments of the at least one focussing device are avoided to a very great extent because the focussing device is not held on an external tank sub-frame which is independent of the drift tube arrangement but is supported within the cavity of the drift tube accelerator on a flat section of the inner base of a massive structured lower steel block, which advantageously replaces the known lower half-shell.

In a further preferred embodiment of the invention, quadrupole magnets arranged as singlets or as multiplets in the special drift tubes are provided as focussing devices. This embodiment of the invention has the advantage that proven components of magnetic lenses are utilised.

Furthermore, in a further embodiment in accordance with the invention, the structured lower steel block or the structured upper steel block or the structured lower and upper steel blocks have, along the focussing devices, a modified cross-section compared to along the regions in which the drift tubes are arranged having alternately arranged drift tube holders. That modification of the cross-section of the cavity in the region of the focussing devices has the advantage of partial compensation of the support volume without mistuning of the electrical field distribution along the longitudinal axis of the drift tube accelerator.

In a further embodiment of the invention, the drift tubes having alternately arranged drift tube holders are arranged with centre-to-centre spacings that increase in the beam direction, thereby advantageously taking into account the increasing velocity of the ion packets as they pass through the drift tube accelerator.

The structured lower steel block or the structured upper steel block or the structured upper and lower steel blocks furthermore have cavities which expand the cross-section of the vacuum tank in certain sections. Associated therewith is the advantage that the decrease in the unit-length-related capacity of the drift tube structure can be compensated to a very large extent and at reasonable cost in manufacturing terms and, in the event of mismatches, re-working is possible at reasonable cost in order to be able to excite the basic mode of the cavity.

In an advantageous embodiment of the invention, the structured lower steel block or the structured upper steel block or the structured upper and lower steel blocks furthermore have cavities which expand the cross-section of the vacuum tank in certain sections in stepwise manner. Stepwise expansion of the cavity cross-section has the advantage that it can be incorporated in the massive lower and upper steel blocks at reasonable cost in manufacturing terms and, in the event of mismatches, re-working is possible at reasonable cost in order to compensate for a very great decrease in the unit-length-related capacity of the drift tube structure and in order to be able to excite the basic mode of the cavity.

It is furthermore possible for additional tuning elements to be arranged on the partly flat inner base of the structured lower steel block or on the partly flat inner covering surface of the structured upper steel block or on the partly flat inner base of the structured lower steel block and on the partly flat inner covering surface of the structured upper steel block. Associated therewith is the advantage that, on the flat inner surfaces of the vacuum tank, it is possible to achieve very good high-frequency and thermal contact between the tuning elements or tuning members and the water-cooled massive half shells and also, as a result, for the tuning elements to be adequately cooled, thereby avoiding damage to the cavity resulting from thermal stresses and overheating.

In a preferred development of the invention, the alternately arranged drift tube holders are guided in longitudinal grooves parallel to the longitudinal axis in the longitudinal ribs of the central unit. A longitudinal groove of such a kind enhances the precise alignment of the drift tube units coaxially with respect to the beam direction and allows fine adjustment of the centre-to-centre spacing of the drift tube units in line with the increasing velocity of the accelerated ion packets by means of displacement of the drift tube holders in the longitudinal grooves. The longitudinal ribs furthermore have a cooling water channel in the longitudinal direction. That cooling water channel has the advantage that it directly cools the longitudinal rib, to which the drift tube holders are fastened, and is accordingly capable of directing heat directly away from the inner wall of the central unit.

It is furthermore advantageous for the central unit to have further cooling water channels in the end faces so that the massive wall of the end face of the central unit likewise contributes to the active directing-away of heat and so that thermal de-adjustment caused by thermal distortion of the components of the drift tube accelerator, especially of the inlet orifice and outlet orifice at the end faces, does not occur.

In a further embodiment of the invention, the structured lower and upper steel blocks have cooling water ducts, which are arranged on their external surfaces. Cooling water ducts of such a kind can be manufactured at reasonable cost and, in addition, are reliable in operation because they are arranged outside the cavity and can be adapted to the external shape of the steel blocks.

For a further embodiment of the invention, the structured lower and upper steel blocks have minimum wall thicknesses of 10 mm, cooling water channels being arranged inside that wall thickness where they do not give rise to weak points with respect to strength.

The present invention makes acceleration possible wherein the ions are accelerated, from the injection energy at the inlet orifice of the central unit to the outlet orifice, from 400 keV/u to 7 MeV/u. For that purpose, the IH drift tube accelerator of the present invention has a length of 3.77 m. When they are accelerated in the IH drift tube accelerator of the present invention, the velocity of the ions increases from about 2.9% of the speed of light to about 12.2% of the speed of light. Analogously, the incremental pitch or the centre-to-centre spacing of the drift tubes or drift tube units also increases along the IH accelerator by a factor of about 4.

In the IH drift tube accelerator according to the invention, compensation of the decrease in the unit-length-related capacity of the drift tube structure is moreover provided in one embodiment of the invention. For that purpose, the structured upper and lower steel blocks have cavities in the individual regions, wherein the cross-section of the vacuum tank is expanded in certain sections. The decrease in the unit-length-related capacity of the drift tube structure is accordingly compensated by the expanding cross-section, as a result of which the basic mode of the cavity can be excited in advantageous manner.

In a preferred embodiment of the invention, the vacuum tank has four inner regions, in which the drift tube units are arranged at an incremental pitch that increases in the beam direction, three triplet lenses for ion beam focussing from region to region, standing on the flat sections of the inner base of the structured lower steel block, being so arranged between the regions that they surround the longitudinal axis of the central unit.

Compared to conventional systems, the use, in accordance with the invention, of only one drift tube accelerator cavity for four inner acceleration regions, especially at the relatively high operating frequency of about 217 MHz for ion accelerators, results in a very long cavity compared to the internal diameter. In one embodiment of the IH drift tube accelerator according to the invention, the internal height of the IH cavity is only 340 mm, the 3718 mm internal length constituting a ratio of internal height to internal length of about 1:11. That ratio of the internal dimensions would make the HF tuning of the cavity substantially more difficult if working with conventional constructional types.

The HF tuning of the cavity can, however, be substantially facilitated by the modifiable mechanical construction of the drift tube accelerator according to the invention. As a result of the provision of a partly flat inner base, it is possible, by simple means, to provide for integration of tuning elements already at the time of manufacture of the cavity and also for the subsequent installation of tuning members. In accordance with the invention, therefore, the structured upper and lower steel blocks in a preferred embodiment of the invention have cavities which expand the cross-section of the vacuum tank in certain sections in stepwise manner for the individual regions.

Accordingly, a high-frequency cavity is achieved for a resonance frequency of about 217 MHz, which has an estimated resonator quality of 12000 to 15000. The cavity itself is operated in pulse operation with an HF pulse duration of 0.5 ms and a pulse repetition rate of 10 Hz, which corresponds to a pulse duty factor of max. about 0.5%. The estimated HF pulse power requirement in the form of power loss of the cavity is about 1.0 to 1.1 MW, which results in an average thermal power consumption of max. about 5 to 6 kW. The thermal energy given off to the tank in the process is achieved as a result of, on the one hand, effective water cooling of the longitudinal ribs in the central unit and, on the other hand, the external surfaces of the structured upper and lower steel blocks.

The vacuum tank consists of three main parts, all three of which are accordingly water-cooled, namely the central unit and the upper and lower half-shells in the form of structured upper and lower steel blocks. The central unit carries the drift tube structure comprising, for example, fifty-two drift tube units each of individual length. The drift tube units are arranged in the above-mentioned four regions. Those four drift tube regions are coupled to one another by means of three integrated quadrupole triplet lenses. A different drift tube type is used in each of the regions. The individual drift tube types differ in their diameters. The drift tubes are carried by drift tube holders, which are soldered to the drift tubes.

The drift tube holders having the soldered-on drift tubes are not directly water-cooled but rather they are introduced into a longitudinal groove of the water-cooled longitudinal rib of the central unit. They are accordingly cooled by means of the thermal conduction of the water-cooled central frame and are made from oxygen-free copper in order to increase the thermal conductivity. The drift tube holders are arranged and fixed in a longitudinal groove in the longitudinal ribs of the central frame. The central frame having the drift tube structure forms a horizontal plane and is part of the central unit. The lower and upper tank half-shell is produced, in accordance with the invention, by means of structured upper and lower steel blocks made from massive steel blocks. For cooling those two structured steel blocks, cooling channels 270 mm wide and 4 mm high can be arranged on the outsides of the structured steel blocks.

The insides of the steel blocks have planar machined-out regions. Those planar machined-out regions have different depths in the four different acceleration regions so that the cross-section is matched in stepwise manner to the unit-length-related capacity of the drift tube structure. By that means there is achieved at least partial compensation of the decrease in the unit-length-related capacity of the drift tube structure along the IH cavity.

Flange-mounted on the lower tank half-shell and on the flat sections of the inner base are the above-mentioned three large focussing devices, each comprising a magnetic quadrupole triplet lens. Along those triplet lenses, the lower structured steel block has a modified cross-section for partial compensation of the support on the inner base necessary for alignment of the triplet lenses.

To summarise, the following advantages of the invention are obtained.

1. By virtue of the mechanically very rigid construction of the tank half-shells in the form of massive structured upper and lower steel blocks and an approximately square cavity cross-section, it is possible to dispense with costly external supporting frames for the compensation of evacuation forces.
2. Partial compensation of the decrease in the unit-length-related capacity of the drift tube structure along the IH cavity can be compensated by modification of the cross-sectional area of the cavity by incorporating a special longitudinal profile in the structured upper and lower steel blocks. That can be accomplished at reasonable cost in manufacturing terms.
3. Subsequent correction of the field distribution of the IH cavity is simplified by means of the structure according to the invention. On the one hand, the contour of the half shells can be optimised by subsequently machining the structured steel blocks and, on the other hand, tuning blocks can be subsequently introduced on the flat inner surfaces of the massive structured steel blocks for the purpose of fine adjustment. The planar contact surfaces therein provide very good high-frequency and thermal contact, which causes problems in the case of conventional semi-cylindrical upper and lower half-shells.
4. By virtue of the mechanically very rigid construction of the structured lower and upper steel blocks, the magnetic quadrupole triplet lenses can be bolted directly into the middle of the steel blocks and require no external supports and no external adjusting devices.

5. Subsequent correction of the triplet axis is possible by means of subsequent mechanical modification of an additionally inserted planar tuning plate, it being possible to achieve an accuracy of a few micrometres. This is, technically, a simpler and cheaper solution than in the prior art, wherein a lens is mounted outside the vacuum tank in the tank sub-frame.
6. Improved accuracy can be achieved in adjustment of the triplet lenses. A maximum deviation of the triplet axis relative to the beam axis of 0.05 mm is achievable along the total triplet length, using the arrangement according to the invention.
7. Finally, the cavity can be opened as often as desired by removing the structured upper steel block without the need for laborious readjustment of the triplet lenses.

By virtue of its stable structure, the invention also solves the problem of the very great, hitherto unachieved increase in ion velocity by a factor of about 4 within one cavity, especially as it has not been possible hitherto to produce a comparatively large ratio between the internal length of the tank to the internal diameter. For such a great increase in ion velocity it has hitherto been necessary in the case of the known drift tube accelerators to have more and more cavities, each of which has a constant cross-sectional area over the entire length of the cavity.

In addition, the IH drift tube accelerator according to the invention avoids considerable additional costs, which were associated with the hitherto customary separation into a plurality of cavities. The use of only one cavity moreover simplifies operation of the system and makes it more reliable because, on the one hand, fewer parameters have to be checked and set and, on the other hand, the number of additional devices to be used is minimised, which reduces the probability of failure of the entire system. Also, it has not been possible hitherto to achieve an operating frequency of over 200 MHz for IH drift tube accelerators having integrated quadrupole triplet lenses in accordance with the prior art.

The construction according to the invention of an IH drift tube accelerator having those above-mentioned novel and advantageous characteristics—especially the use of only one cavity for acceleration over a comparatively wide energy range—and the solving of the problems specifically associated therewith—especially the partial compensation of the decrease in the unit-length-related capacity of the drift tube structure along the IH cavity by means of the stepwise modification of the tank cross-section, the space-saving and mechanically rigid integration of extremely compact triplet lenses and also the simple possibility of installing additional tuning members on the planar inner surfaces of the structured upper and lower steel blocks—are considerably simplified by means of the newly developed construction of the tank half-shells from massive steel blocks.

The invention will be explained below in further detail with reference to the accompanying Figures.

Figure 1:
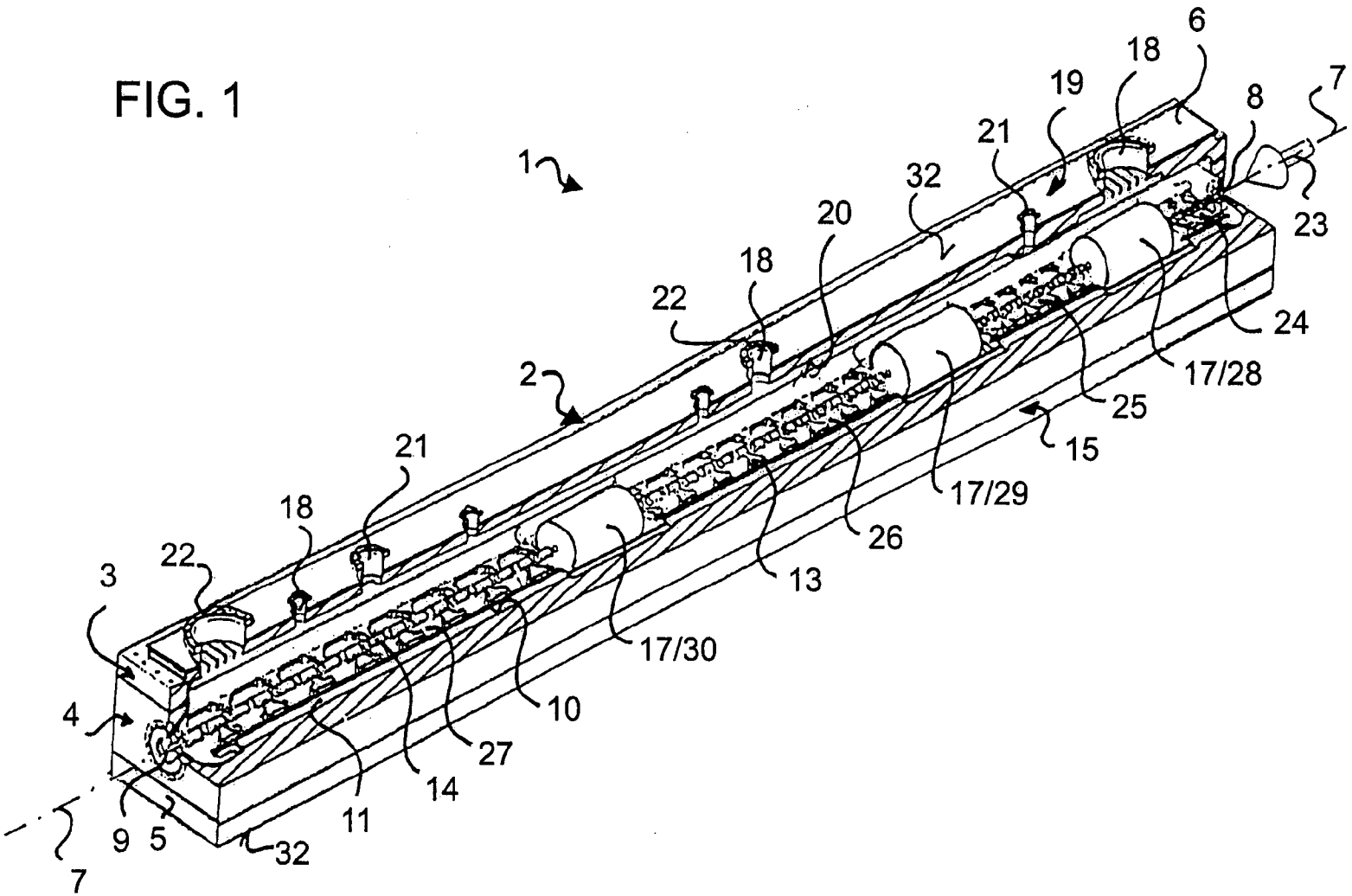
FIG. 1 is a perspective view, in diagrammatic form, of a drift tube accelerator according to an embodiment of the invention.

FIG. 1 is a perspective view, in diagrammatic form, of a drift tube accelerator 1 according to an embodiment of the invention. The drift tube accelerator is accommodated in a housing 2 in the form of a vacuum tank 3. That housing 2 has a central unit 4 having a central frame, the central unit 4 being bolted—in vacuum-tight manner—onto a lower half-shell 5 comprising a massive structured lower steel block 15. An upper half-shell 6 has a massive structured upper steel block 19, which has a partly flat inner covering surface 20 and which, for the purpose of covering the cavity of the drift tube accelerator 1, is removably bolted onto the central unit 4.

Before the structured upper steel block 19 is bolted onto the central unit 4, the individual drift tube components are accommodated in the elongate cavity of about 3770 mm. The housing 2 has four acceleration regions 24, 25, 26 and 27 for the purpose. Arranged between the acceleration regions 24, 25, 26 and 27 are focussing devices 17, those focussing devices 17 consisting of quadruple triplet lenses 28, 29 and 30. Those triplet lenses surround the longitudinal axis 7, in which the ion beam packets are shot through the central unit in the beam direction 23 and accelerated.

Because the ions are accelerated from 2.9% to about 12.2% of the speed of light on passage through the resonator, the incremental pitch between individual drift tube units 14 increases by a factor of about 4 along the IH drift tube accelerator 1, which necessitates compensation measures for the decrease in the unit-length-related capacity of the drift tube structure. Those measures, for example modifying the cross-section of the cavity, are accomplished by structuring of the massive lower and upper steel blocks 15 and 19.

Further details of the embodiment of the invention according to FIG. 1 are explained in the subsequent FIGS. 2 to 11.

Figure 2:
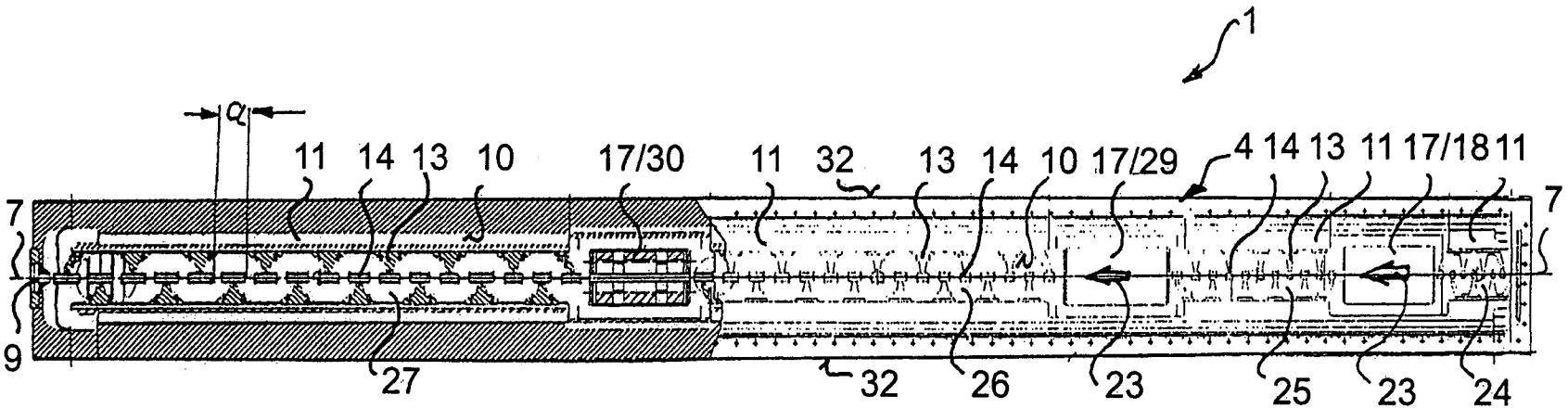
FIG. 2 is a partly cut-away top view, in diagrammatic form, onto the central unit of the drift tube accelerator according to FIG. 1.

FIG. 2 is a partly cut-away top view, in diagrammatic form, onto the central unit 4 of the drift tube accelerator 1 according to FIG. 1. Components having the same functions as in FIG. 1 are referred to by the same reference numerals and are not separately discussed.

In the non-cut-away part of the central unit 4 the arrangement of the resonance components of the drift tube accelerator can be seen. The lengths of the drift tube units 14 also increase within the acceleration regions 24, 25, 26 and 27. Those drift tube units 14 are so held by drift tube holders 13 that they surround the longitudinal axis 7 of the central unit 4 in coaxial manner. Furthermore, by means of their drift tube holders 13, the drift tube units 14 are fastened, in alternating manner, to the inner walls 10 of the central unit 4 located opposite one another. For that purpose, the two inner walls 10 of the central unit have, in each of the four regions 24, 25, 26 and 27, a longitudinal rib 11 bearing a longitudinal groove, in which the drift tube holders 13 are fastened with a centre-to-centre spacing a that increases in the beam direction. In the regions of the three triplet lenses 28, 29 and 30, the spacing between the inner walls 10 of the central unit 4 is expanded slightly in order to adjust the capacity between the inner walls of the central unit and the triplet lenses so that the requisite electrical field distribution along the longitudinal axis of ion beam guidance of the drift tube accelerator is achieved.

Figure 3:
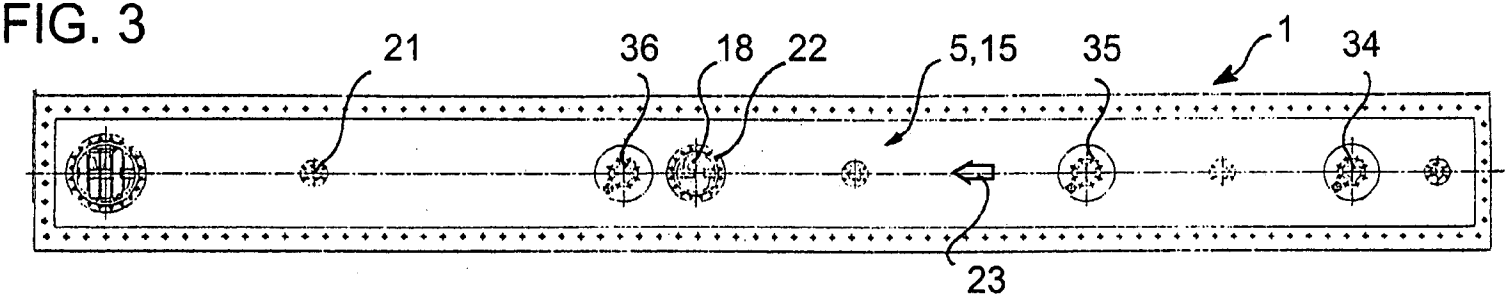
FIG. 3 is a bottom view, in diagrammatic form, of the structured lower steel block of the drift tube accelerator according to FIG. 1.

FIG. 3 is a bottom view, in diagrammatic form, of the structured lower steel block 15 of the drift tube accelerator 1 according to FIG. 1, orifices 21 having corresponding vacuum flanges 22 being arranged on that flat bottom surface of the lower steel block 15. The triplet lenses 24, 25 and 26 shown in FIG. 2 are supplied with power and with cooling water by way of the three vacuum ports 34, 35 and 36 in the structured lower steel block 15. The remaining vacuum flanges are used in part for measurement purposes and in part for supplying the resonator with high-frequency alternating current of the order of magnitude of above 200 MHz.

Figure 4:
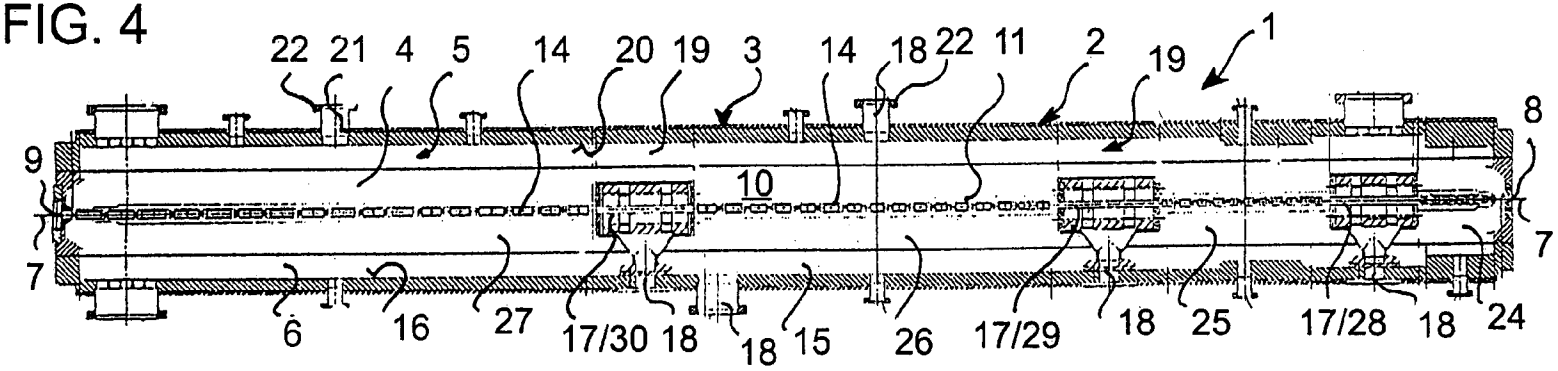
FIG. 4 is a longitudinal section, in diagrammatic form, through the drift tube accelerator according to FIG. 1.

FIG. 4 is a longitudinal section, in diagrammatic form, through the drift tube accelerator 1 according to FIG. 1. This longitudinal section shows the inlet orifice 8 and the outlet orifice 9 in the region of the central unit 4. In addition, it is made clear that the cross-section of the cavity in the four acceleration regions 24, 25, 26 and 27 is expanded in stepwise manner in order to compensate for the decrease in the unit-length-related capacity of the drift tube structure so that the basic mode of the cavity can be excited.

Figure 5:
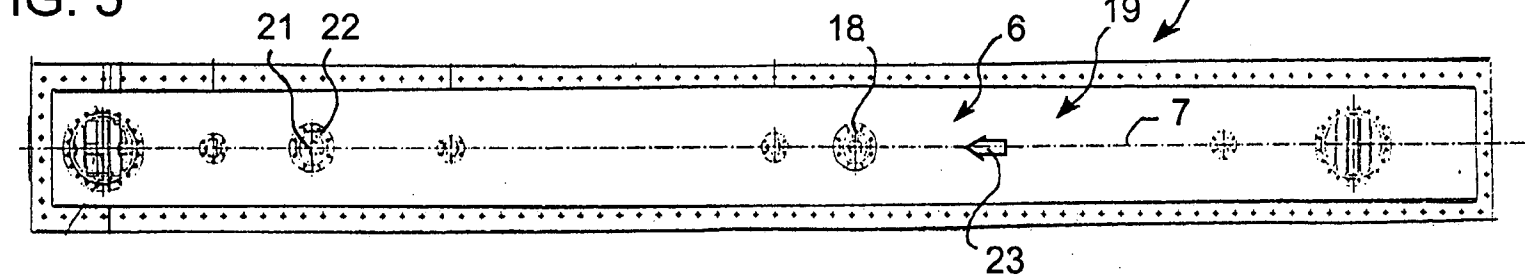
FIG. 5 is a top view, in diagrammatic form, onto the structured upper steel block of the drift tube accelerator according to FIG. 1.

FIG. 5 is a top view, in diagrammatic form, onto the structured upper steel block 19 of the drift tube accelerator 1 according to FIG. 1. Components having the same functions as in the previous figures are referred to by the same reference numerals and are not separately discussed. This top view also shows the advantage of the flatness of the external contour of the structured upper steel block 19, which facilitates the fitting of vacuum flanges and vacuum ports and the welding-on of a cooling water channel.

Figure 6:
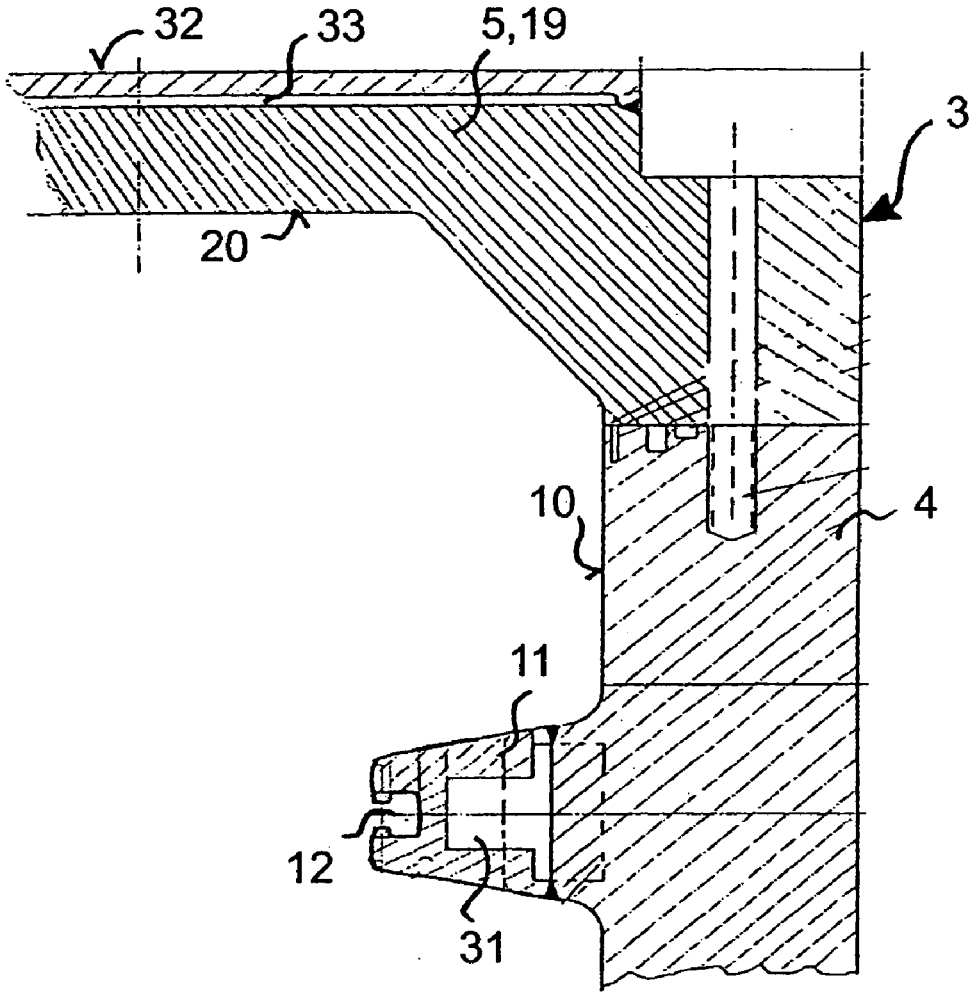
FIG. 6 is a cross-section, in diagrammatic form, through a transition from the structured upper steel block to the central unit of the drift tube accelerator according to FIG. 1.

FIG. 6 is a cross-section, in diagrammatic form, through a transition from the structured upper steel block 19 to the central unit 4 of the drift tube accelerator 1 according to FIG. 1. The detailed drawing of FIG. 6 shows the intensive cooling of the longitudinal rib 11 by the cooling water channel 31, by means of which the lost heat can be given off from the drift tube holders arranged in the longitudinal groove 12 to the central unit 4. The longitudinal rib 11 is welded onto the inner wall 10 of the central unit 4 so as to form the cooling water channel 31 and the longitudinal groove 12 is introduced after the welding in order to compensate for welding stresses and welding distortions.

The arrangement of a cooling water channel 33 on the external surface 32 of the structured upper steel block 19 is also shown here merely by way of example, in the form of a 4 mm high and 240 mm wide cooling water channel, which is obtained by welding an outer plate onto the structured upper steel block 19. The cooling action can be further intensified by both the central unit 4 and also the structured upper steel block 19 additionally having cooling water channels machined into the material.

Figure 7:
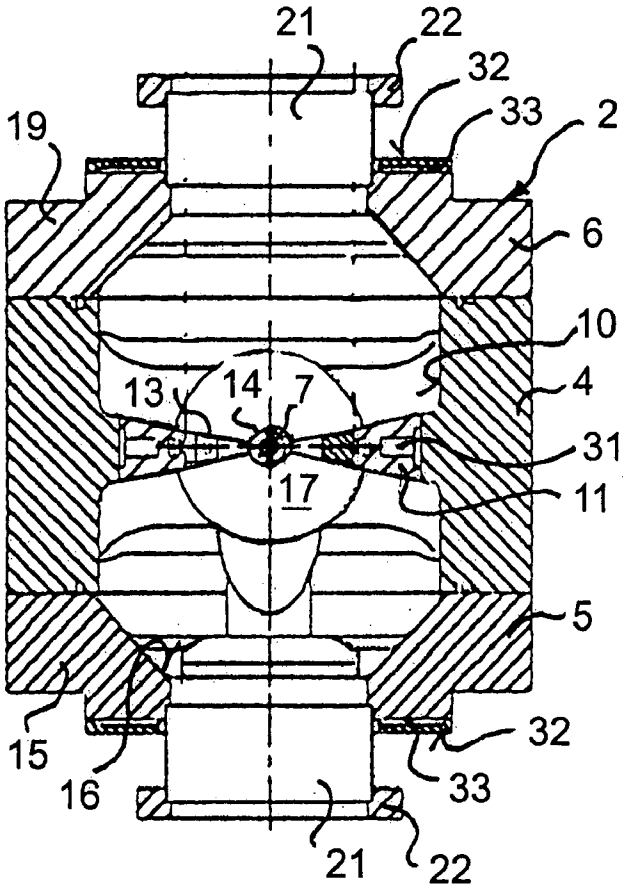
FIG. 7 is a cross-section, in diagrammatic form, through the drift tube accelerator according to FIG. 1 in the region of a drift tube holder.

FIG. 7 is a cross-section, in diagrammatic form, through the drift tube accelerator 1 according to FIG. 1 in the region of a drift tube holder 13. Components having the same functions as in the previous figures are referred to by the same reference numerals and are not separately discussed. In that cross-section, relatively large pumping-out connections have been incorporated in the upper and lower structured steel blocks 19 and 15, respectively, in order to evacuate the cavity of the drift tube accelerator to $10^{-5}$ Pascals. For the purpose of holding the drift tube units coaxially with respect to the longitudinal axis 7, the drift tube holders 13 are fastened in the longitudinal groove 12 of the cooled longitudinal rib 11.

Figure 8:
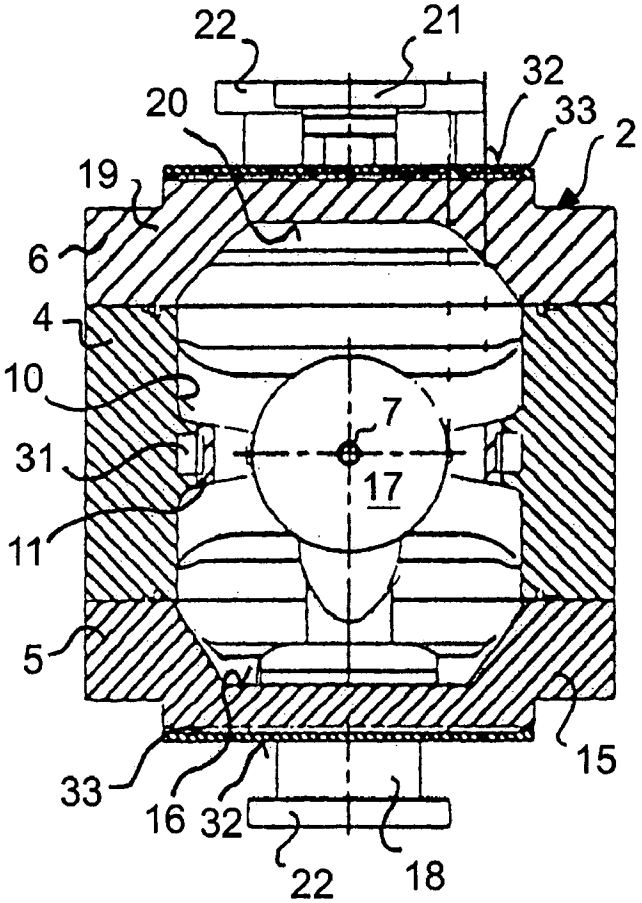
FIG. 8 is a cross-section, in diagrammatic form, through the drift tube accelerator 1 according to FIG. 1 in the region of a focussing device.

FIG. 8 is a cross-section, in diagrammatic form, through the drift tube accelerator 1 according to FIG. 1 in the region of a focussing device 17. The focussing device 17 stands on the flat inner base 16 of the lower structured steel block 15, which replaces, in accordance with the invention, the conventional half shell. The focussing device 17 of a quadrupole triplet lens is supplied with power and with cooling water by way of the vacuum port 18. Components having the same functions as in the previous figures are referred to by the same reference numerals and are not separately discussed.

Figure 9:
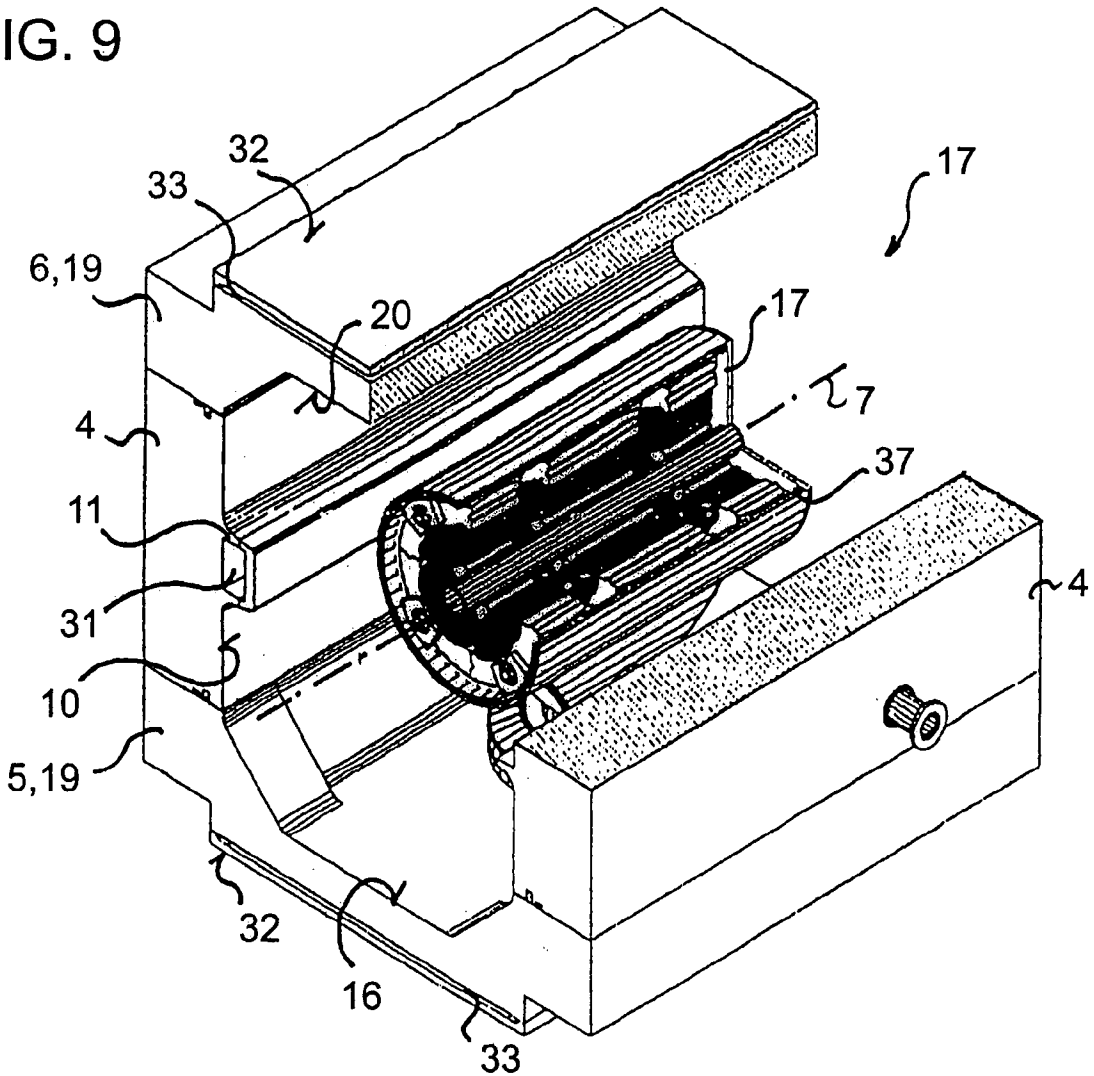
FIG. 9 is a perspective view, in diagrammatic form, of a drift tube accelerator according to FIG. 1 in the region of a focussing device.

FIG. 9 is a perspective view, in diagrammatic form, of a drift tube accelerator 1 according to FIG. 1 in the region of a focussing device 17. The focussing device 17, in the form of a triplet lens, is arranged in a water-cooled housing 37. The cross-section of the cavity is modified according to the size of the triplet lens, the wall thickness of the central unit 4 being reduced and the base area of the inner base 16 in the region of the focussing device 17 being increased.

Figure 10:
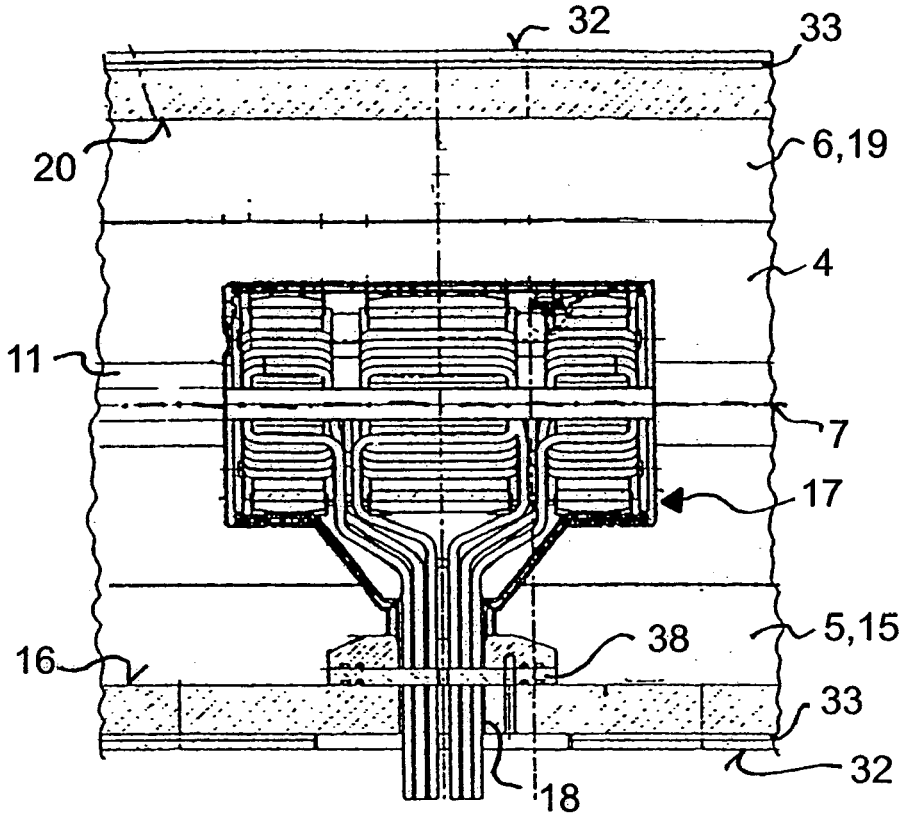
FIG. 10 is a longitudinal section, in diagrammatic form, through a focussing device of the drift tube accelerator according to FIG. 1.

FIG. 10 is a longitudinal section through a focussing device 17 of the drift tube accelerator 1 according to FIG. 1. Components having the same functions as in the previous figures are referred to by the same reference numerals and are not separately discussed. A subsequent correction to the longitudinal axis 7 is possible by means of subsequent mechanical modification of the tuning plate 38 inserted in this case, it being possible to achieve an accuracy of a few micrometres. This is possible because a flat inner base 16 is provided in the lower structured steel block 15 in the present invention for positioning and adjusting the triplet lenses. It is, in addition, possible, as a result of the fastening of the triplet lenses on the flat inner base 16, for the upper structured steel block 19 to be lifted off from the central unit 4 without having to carry out readjustment of the triplet lens.

Figure 11:
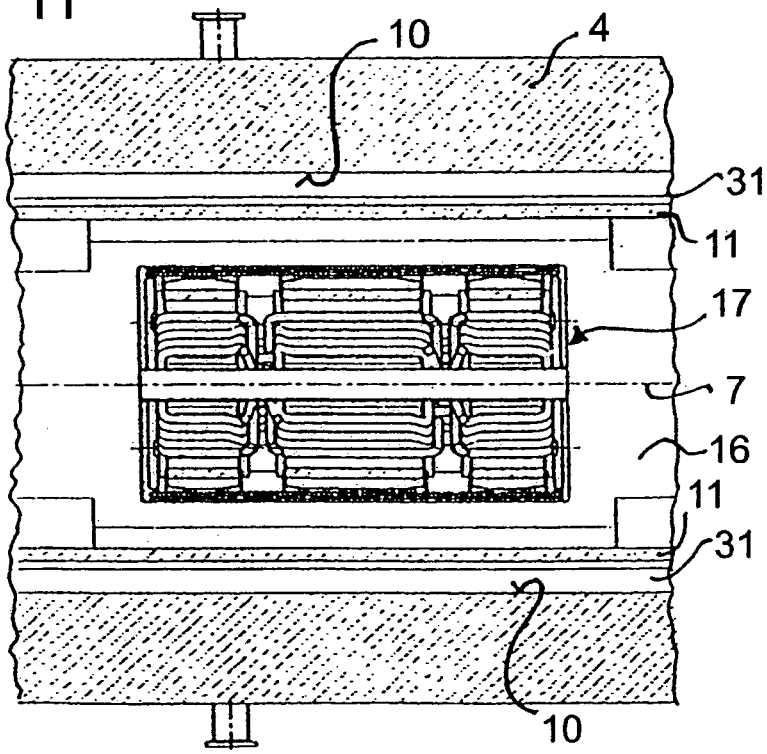
FIG. 11 is a longitudinal section, in diagrammatic form, through the central unit in the region of the focussing device of FIG. 10.

FIG. 11 is a longitudinal section through the central unit 4 in the region of the focussing device 17 of FIG. 10. Components having the same functions as in the previous figures are referred to by the same reference numerals and are not separately discussed. This longitudinal section shows that the triplet lens is so arranged on the flat inner base 16 of the lower structured steel block 15 without any lateral support at the central unit 4 that the axis of the triplet lens is exactly aligned with respect to the beam axis without the need for lateral supporting aids to the central unit 4.

LIST OF REFERENCE SYMBOLS

1 drift tube accelerator
2 housing
3 vacuum tank
4 central unit
5 lower half-shell
6 upper half-shell
7 longitudinal axis
8 inlet orifice

9 outlet orifice
10 inner wall of central unit
11 longitudinal rib
12 longitudinal groove
13 drift tube holder
14 drift tube unit
15 structured lower steel block
16 flat inner base
17 focussing device
18 vacuum port
19 structured upper steel block
20 inner covering surface
21 orifices in covering surface
22 vacuum flange
23 beam direction
24 first inner region
25 second inner region
26 third inner region
27 fourth inner region
28 first triplet lens
29 second triplet lens
30 third triplet lens
31 cooling water channel in longitudinal rib
32 external surface of steel blocks
33 cooling water channel in upper and lower steel blocks
34 vacuum ports to the triplet lenses
35 vacuum ports to the triplet lenses
36 vacuum ports to the triplet lenses
37 triplet lens housing
38 tuning plate
a centre-to-centre spacing of drift tube units

The invention claimed is:

1. A drift tube accelerator for the acceleration of ion packets in ion beam acceleration systems, comprising:

a housing (2) comprising a longitudinally divided three-part vacuum tank (3) having:
a central unit (4),
a lower half-shell (5), and
an upper half-shell (6);

the central unit (4) having on its longitudinal axis (7) of ion beam guidance an inlet orifice (8) and an outlet orifice (9) for the ion packets and there being arranged, on its inner wall (10), longitudinal ribs (11) located opposite one another and carrying alternately arranged drift tube holders (13), which in turn hold drift tube units (14) coaxially with respect to the longitudinal axis (7) of ion beam guidance, and the central unit (4) being removably mounted on the lower half-shell (5) and removably covered by the upper half-shell (6);

the lower half-shell (5) comprising a structured steel block (15) having a partly flat inner base (16), on which vacuum ports (18) are arranged; and the upper half-shell (6) comprising a structured steel block (19), which has a partly flat inner covering surface (20) having vacuum ports (18), the vacuum tank (3) having at least two inner regions (24, 25) in which the drift tubes units (14) are arranged, including a special drift tube, comprising a focusing device (17) for transverse ion beam focusing and standing on the partly flat inner base (16) of the structured steel block (15), being so arranged between each of the regions that it surrounds the longitudinal axis (7) of the central unit (4).

2. Drift tube accelerator according to claim 1,
wherein quadrupole magnets arranged as singlets or as multiplets in the special drift tubes are provided as focussing devices (17).

3. Drift tube accelerator according to claim 1,
wherein the structured lower steel block (15) or the structured upper steel block (19) or the structured lower and upper steel blocks (15, 19) have, along the focussing devices (17), a modified cross-section compared to along the regions in which the drift tubes (14) are arranged having alternately arranged drift tube holders (13).

4. Drift tube accelerator according to claim 1,
wherein the drift tubes (14) having alternately arranged drift tube holders (13) are arranged with centre-to-centre spacings that increase in the beam direction.

5. Drift tube accelerator according to claim 1,
wherein the structured lower steel block (15) or the structured upper steel block (19) or the structured upper and lower steel blocks (15, 19) have cavities which expand the cross-section of the vacuum tank (3) in certain sections.

6. Drift tube accelerator according to claim 1,
wherein the structured lower steel block (15) or the structured upper steel block (19) or the structured lower and upper steel blocks (15, 19) have cavities which expand the cross-section of the vacuum tank (3) in certain sections in stepwise manner.

7. Drift tube accelerator according to claim 1,
wherein additional tuning elements (38) are arranged on the partly flat inner base (16) of the structured lower steel block (15) or on the partly flat inner covering surface (20) of the structured upper steel block (19) or on the partly flat inner base (16) of the structured lower steel block (15) and on the partly flat inner covering surface (20) of the structured upper steel block (19).

8. Drift tube accelerator according to claim 1,
wherein the alternately arranged drift tube holders ((14)) (13) are guided in longitudinal grooves (12) parallel to the longitudinal axis (7) in the longitudinal ribs (11) of the central unit (4).

9. Drift tube accelerator according to claim 1,
wherein the longitudinal ribs (11) have a cooling water channel (31) in the longitudinal direction.

10. Drift tube accelerator according to claim 1,
wherein the central unit (4) has further cooling water channels in the end faces.

11. Drift tube accelerator according to claim 1,
wherein the structured lower and upper steel blocks (15, 19) have cooling water ducts (33), which are arranged on their external surfaces (32).

12. Drift tube accelerator according to claim 1,
wherein the structured lower and upper steel blocks (15, 19) have minimum wall thicknesses of 10 mm.

* * * * *